US007410457B2

(12) United States Patent
Heinrich

(10) Patent No.: US 7,410,457 B2
(45) Date of Patent: Aug. 12, 2008

(54) SEPARATOR WITH A DISC STACK WITH RISING CHANNELS AND NON-RADIAL DISTRIBUTOR CHANNELS

(75) Inventor: Holger Heinrich, Ennigerloh (DE)

(73) Assignee: Westfalia Separator AG, Oelde (DE)

( * ) Notice: Subject to any disclaimer, the term of this patent is extended or adjusted under 35 U.S.C. 154(b) by 0 days.

(21) Appl. No.: 10/566,295

(22) PCT Filed: Aug. 4, 2004

(86) PCT No.: PCT/EP2004/008734

§ 371 (c)(1),
(2), (4) Date: Mar. 8, 2007

(87) PCT Pub. No.: WO2005/016543

PCT Pub. Date: Feb. 24, 2005

(65) Prior Publication Data

US 2008/0015099 A1 Jan. 17, 2008

(51) Int. Cl.
*B04B 1/08* (2006.01)

(52) U.S. Cl. ..... 494/70

(58) Field of Classification Search ..... 494/2–4, 494/27, 65, 67–73
See application file for complete search history.

(56) References Cited

U.S. PATENT DOCUMENTS

| | | | | |
|---|---|---|---|---|
| 993,791 | A | 5/1911 | Ohlsson | |
| 4,366,138 | A | 12/1982 | Eisenmenger et al. | |
| 4,427,407 | A * | 1/1984 | Paschedag | 494/70 |
| 6,475,132 | B2 * | 11/2002 | Zettier | 494/65 |
| 2008/0015099 | A1 * | 1/2008 | Heinrich | 494/68 |

FOREIGN PATENT DOCUMENTS

| | | | |
|---|---|---|---|
| DE | 28 46 405 | A1 | 5/1980 |
| DE | 3714399 | C1 * | 4/1988 |
| DE | 38 80 194 | T2 | 8/1993 |
| DE | 100 55 398 | C1 | 11/2000 |
| EP | 0 291 981 | B1 | 11/1988 |
| WO | WO 96/25234 | A1 | 8/1996 |

* cited by examiner

*Primary Examiner*—Charles E Cooley
(74) *Attorney, Agent, or Firm*—Barnes & Thornburg LLP

(57) ABSTRACT

A separator including a vertical axis of rotation, a drum having solids discharge openings and a conical centrifugal space, and a disc stack located in the conical centrifugal space. Also included is a plurality of conical discs super-imposed on one another and having disc bores forming at least one rising channel in the disc stack. Further included is a drum, a distributor and a lower base section which expands radially, and on which lower base section are one or more distributor channels.

26 Claims, 5 Drawing Sheets

SEPARATOR WITH A DISC STACK WITH RISING CHANNELS AND NON-RADIAL DISTRIBUTOR CHANNELS

BACKGROUND AND SUMMARY

The present disclosure relates to a separator having a vertical axis of rotation and a drum with solids discharge openings in a single-cone or double-cone centrifugal space. The separator also includes a disk stack of super-imposed conical disks. The discs have bores forming at least one channel in the disk stack. The separator includes a distributor having a shaft concentrically surrounding a drum axis and a lower base section which expands radially. In the lower base section, one or more distributor channels are distributed in the form of bores.

It has been known for a long time to arrange disc stacks consisting of a plurality of discs situated axially above one another in the direction of the disc axis concentrically to the machine or drum axis in centrifugal drums of separators. This is known from the field of separators with drums with a vertical axis of rotation and solids discharge openings in a pulp space outside the disc stack.

In the case of separators with a vertical axis of rotation, a feeding of the product into the centrifugal drum takes place along the drum axis through a feeding pipe and radial distributor channels connected behind the feeding pipe. The product enters the centrifugal drum into the disc stack consisting of separating discs which are generally situated closely above one another but are nevertheless spaced relative to one another in the area of the essential disc surfaces and, as a rule, are conical. At the discs, heavier solids generally accumulate on the bottom side and move to the outer circumference of the disc stack, while the liquid flows toward the interior, in, for example, a two-phase liquid-solid separation.

For the implementation of a liquid-liquid-solid separation, that is, a three phase liquid-solid separation, it is also known to provide the disc stack with so-called rising channels, which are formed of bores in the discs of the disc stack situated directly or with a twist (see German Patent Document DE 100 55 398 A1) above one another.

From U.S. Patent Document US 993,791, a chamber centrifuge is known which has no solids discharge openings and in which the diameter of the bores changes within a disc stack. Or, the orientation of the openings is changed from one disc to the next in that a disc holding contour sloped toward the axis of rotation is arranged, for example, at the shaft.

The discharge of the liquids generally takes place in areas radially on the inside or radially on the outside with respect to the discs of the disc stack. It is also known to construct discharge channels for the liquid phase(s) by means of bores particularly close to the inner circumference as well as close to the outer circumference of the disc stack in the disc stack (see, for example, German Patent Document DE 284640).

It is also known to equip the discs with so-called spacers in the manner of webs and/or small tips or points which, on the one hand, provide a mutual spacing of the discs and, on the other hand, influence the flow conditions in the disc stack. Spacers can be placed between the discs which preferably are separate from the discs. The discs are generally held in grooves on a distributor shaft or in other disc holders.

The present disclosure relates to optimizing the flow conditions in the drum of a separator by simple constructive devices.

The present disclosure further relates to a separator having a vertical axis of rotation and a drum with solids discharge openings in a single-cone or double-cone centrifugal space.

The separator also includes a disk stack of super-imposed conical disks. The discs have bores forming at least one channel in the disk stack. The separator includes a distributor having a shaft concentrically surrounding a drum axis and a lower base section which expands radially. In the lower base section, one or more distributor channels are distributed in the form of bores. A diameter of the at least one channel inside the disc stack, located above the disc which is the lowest in a flow direction, is not constant and/or is arranged to be sloped with respect to an axis of rotation of the drum. The bores of the at least one distributor channel are not radially oriented with respect to the drum axis in the drum.

Illustrative embodiments are described herein.

As noted above, a diameter of the at least one channel, within the disc stack above the lowermost disc in a flow direction, is not constant and/or the at least one channel is arranged in a sloped manner with respect to the axis of the drum. The bores of the at least one distributor channel do not have a radial orientation to the drum axis in the drum.

According to the present disclosure, it becomes possible, for example, in the case of a centrifuge with a pulp space outside the disc stack, with a piston valve arrangement or solids discharge nozzles to optimize the flow conditions in the drum. Further, according to the present disclosure, a combination of one or more of the above-noted features, that is distributor and channel geometry and/or channel orientation, may be utilized for optimizing the flow conditions in the centrifuge in a constructively simple manner and to optimally adapt them to the product to be processed.

It is noted that German Patent Document DE 38 80 19 shows a centrifuge of a different type with an inlet pipe which is not concentrically arranged.

A geometry of the bores of the discs of the at least one channel, which may be a rising channel, varies in the channel in such a manner that, during the operation, gaps between the discs are uniformly charged with liquid over the entire height of the disc stack. As a result of this advantageous measure, the flow conditions in the centrifuge are clearly optimized. Thus, not only a simple widening of the bores "from one disc to the next" is implemented but a flow-dependent optimization, in the case of which the bores can be designed to be constant over several discs and will then, for example, widen. In this manner, each disc separately can have an optimal design. On the production side, this can be easily implemented by laser cutting the bores in the metal sheet of the discs.

For example, the diameter of the channel can change in steps at a distance of several discs or continuously from one disc to the next and decrease in the flow direction. It is expedient for the diameter to decrease, for example, continuously, in the flow direction.

The bores may have an arbitrary shape. An optimal shape is determined by a person skilled in the art by tests as a function of the product. Thus, the bores may have a polygonal or round or curved shape in any alignment.

In an illustrative embodiment, each channel includes several bores which, in turn, advantageously may also form a perforated pattern for example, distributed on the circumference on a circle or an ellipse in the discs.

It is within the scope of the present disclosure that the at least one channel, which may be sloped, extends in a curved manner with respect to the drum axis in the disc stack.

In such an embodiment, the at least one channel may comprise a rising channel for feeding the product into the disc stack and/or, at least one discharge channel for discharging the liquid phase from the disc stack. The optimized design of rising and discharge channels also contributes to improving the flow conditions.

One of the discharge channels for discharging various liquid phases is constructed close to the inner circumference or close to the outer circumference of the disc stack and/or is constructed inside the disc stack. The flow direction extends in the direction of the liquid discharges of the drum, with the vertical orientation generally in the upward direction.

Based upon the present disclosure, it becomes possible to optimize the further development of the channels of a separator with a vertical axis of rotation as a function of the product and the machine in order to improve the parallel connection of the discs of the disc stack and to optimize the flow conditions. That is done in order to, for example, compensate separating zone displacements because of pressure differences in the disc stack, for example a radial position and to reduce instabilities in the disc stack, for example, in the circumferential direction.

The present disclosure also includes providing a distributor with at least one distributor channel constructed as a bore in a distributor base. Such a distributor channel is not oriented radially in the drum, which, in turn, optimizes the flow conditions in a simple manner as a function of the product.

According to the present disclosure, the distributor channels may be oriented in a sloped manner against the rotating direction of the drum or under certain circumstances in the rotating direction of the drum.

The distributor channels, which are formed by bores relative to the radial line through the drum axis in a radially interior bore section against the rotating direction of the drum, advantageously may be oriented to be sloped in a lagging manner.

As a result of that orientation, the flow conditions are further optimized in combination with the measure that the distributor channels lead in a further bore section into the drum, which bore section is oriented upwards in the drum and leads out directly below a rising channel of the disc stack into the drum. In addition, a more careful acceleration and an optimal entry of the centrifugal material into the rising channels is ensured.

The distributor channels may have an expanding round or a slot-type outlet which extends tangentially in or against the rotating direction of the drum and/or is directed upward in the drum.

Other aspects of the present disclosure will become apparent from the following descriptions when considered in conjunction with the accompanying drawings.

DETAILED DESCRIPTION

Figure 1:
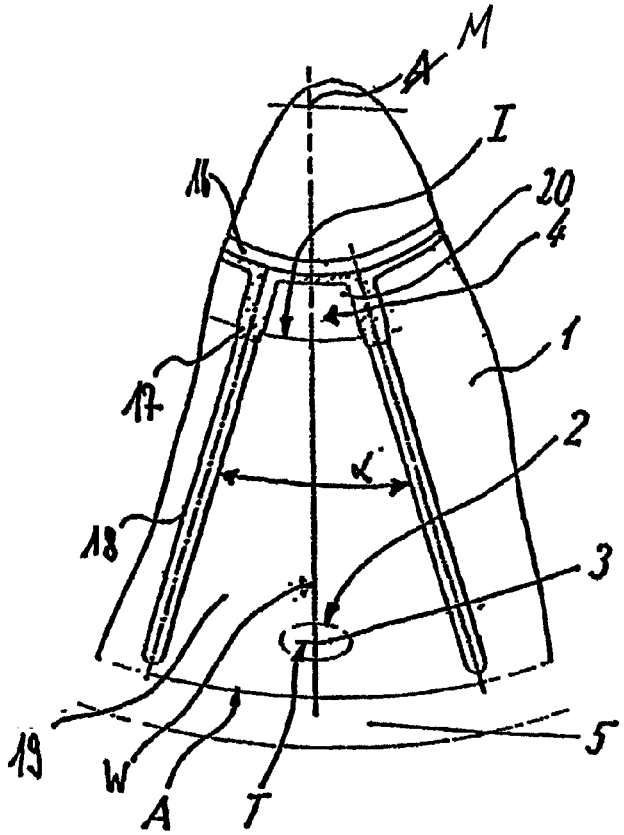
Fig. 1 (PRIOR ART)
FIG. 1 is a top view of a partial area of a known disc for disc-type centrifuges having a vertical axis of rotation.

FIG. 1 shows a top view of a partial area of a known disc 1 of a disc stack for a separator.

According to FIG. 1, the discs 1 each have a disc bore 2. The bores 2 or holes of the discs 1, in cooperation with several discs 1 arranged above one another, form a rising channel 3 which is situated radially in an area of a separating zone T between a lighter and a heavier liquid phase. In an area 4, a discharge of a light liquid phase takes place radially on an inside with respect to the discs 1, and a discharge of a heavier liquid phase takes place in an area 5 radially outside the disc 1. Solids exit a disc stack 26 toward an outside (not shown) and can be discharged there in a known manner, for example, through nozzles or a piston valve arrangement from a centrifugal drum.

The disc stack 26 or the individual discs 1 are pushed onto a distributor shaft 16 which includes, on its outer circumference, a plurality of webs 17 directed radially from the shaft 16 to an outside, which webs 17 protrude beyond an inner circumference I of the discs 1 and thereby non-rotatably secure the discs 1 on the distributor shaft 16 relative to the shaft 16.

As a radial extension of the webs 17, radially directed spacers or lugs 18 are arranged between the discs 1, which spacers 18 divide the discs 1 completely into segments 19 with an opening angle $\alpha$, in which one bisecting line W is situated.

The area 4 for discharging the light phase is formed by grooves 20 in the outer circumference of the distributor shaft 16 between the webs 17, which grooves 20 are placed symmetrically with respect to the bisecting lines W in the distributor shaft 16.

Figure 2:
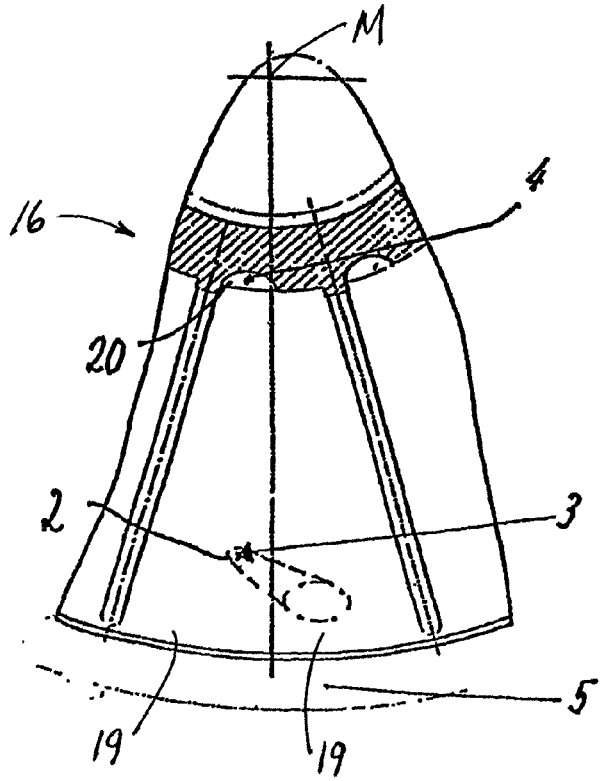
FIGS. 2 to 8 are top views of a partial area of embodiments of different discs for disc-type separators or centrifuges having a vertical axis of rotation, according to the present disclosure.

According to FIG. 2, the rising channel 3 has a cross-section which is not constant. That is, a diameter of the bores 2 of the discs 1 of the disc stack 26, which form the rising channel 3, is not constant. The diameter changes over an entire height of the disc stack 26 and it is reduced continuously along the entire height of the disc stack 26 in a flow direction F (see FIG. 9).

It is noted that it is known from British Patent Document GB 264,777 to provide the lowermost disc with a different hole or bore arrangement than the upper discs in order to cover a portion of the discs and be able to thereby radially displace the rising channel by exchanging the lowermost disc.

The diameter of the bore 2, as shown in FIG. 2, for a drum with a vertical axis of rotation, continuously decreases in an upward direction (indicated by a broken line), so that the diameter of the rising channel 3 is also reduced in the upward direction.

In addition, the rising channel 3, as shown in FIG. 2, is not situated parallel to a drum axis M which is perpendicular to a plane of the figure. As a result, the bores 2 of discs 1 situated above one another are no longer aligned completely but only in sections, so that the rising channel 3 may, for example, extend in the upward direction radially from the outside farther toward the inside and/or in or against a rotating direction in a circumferential direction and may therefore have a twist.

According to FIG. 2, the groove 20 in the distributor shaft 16 for forming a discharge channel or discharge area 4 is not symmetrically aligned with respect to the bisecting line W of each disc segment 19 but is asymmetrically laterally offset. This can also optimize the flow conditions in the disc stack 26.

Figure 3:
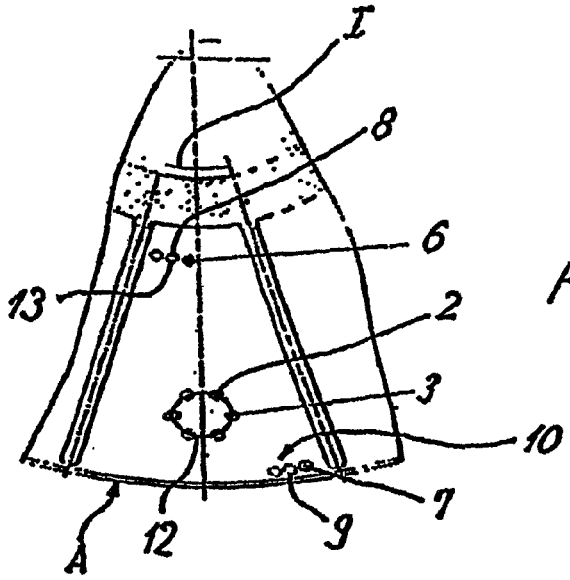
Figure 4:
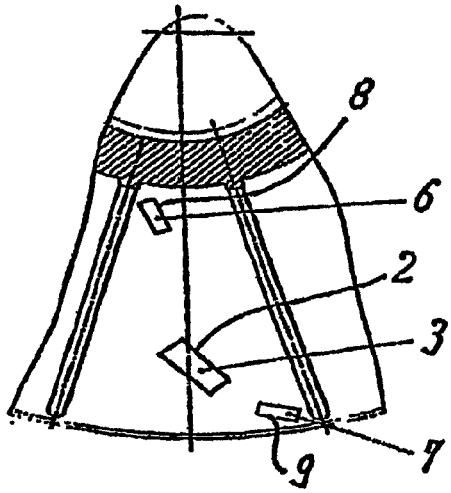
Figure 5:
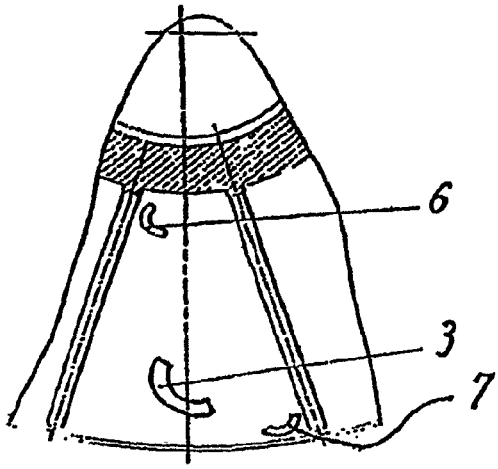

According to FIGS. 3 to 5, discharge channels 6, 7 are constructed directly in the disc stack 26. That is, a first discharge channel 6 for a light liquid phase is constructed radially outside the inner circumference I of the discs 1 in the disc stack 26, and a second discharge channel 7 for a heavier liquid phase is constructed radially inside the outer circumference A of the discs 1. These channels 6, 7 also may be aligned not only symmetrically but also asymmetrically with respect to the bisecting line W of each disc segment 19. This also applies to the rising channels 3 for the product feed.

The discharge channels 6, 7 are formed analogously to the rising channels 3 by bores 8, 9 in the discs 1 situated above one another, which bores 8, 9 are situated close to the inner I or outer A circumference of the discs 1. The discharge channels 6, 7 may again have a diameter which is not constant and/or may not be situated directly above one another but offset with respect to one another relative to a drum axis M. To this extent, all of the arrangements of the bores 2 for the rising channels 3 mentioned above or below can be analogously utilized also when further developing the bores 8, 9 for the discharge channels 6, 7.

According to FIG. 3, the bores 8 of the inner discharge channel 6 for the light liquid phase and/or the bores 9 of the discharge channel 7 for the heavier phase and/or the bores 2 of the rising channel 3 may include several bores 2, 8, 9 in a manner of a multiple perforation 10. In this case, individual bores can be arranged, for example, in a circle 12, in a radially oriented straight line or in a curve oriented in the circumferential direction or a straight line 13. The curves or straight lines may be arbitrarily oriented in an angular and/or offset manner with respect to the bisecting line W of the segment 19 or to other radial lines through the drum axis M of the centrifuge depending on the application.

According to the present disclosure, a division of the product flow into many small channels represents an improvement with respect to the uniform charging of the disc stack 26*s* and optimizes the flow conditions in the disc stack 26.

The individual bores 2, 8, 9 may have any geometry. Thus, a circular shape or a polygonal shape, for example, a triangular or square shape, as shown in FIG. 4 or a curved shape, as shown in FIG. 5. The polygon or the other geometrical shapes can be oriented at any angle with respect to the bisecting line W of the angle.

It is advantageous to mutually adapt the geometry of the bores 2, 8, 9 of a rising channel 3 such that gaps between the discs 1 are uniformly charged with liquid over the entire height of the disc stack 26 or the rising channel 3. This can be achieved by tests and/or theoretical considerations, such as computer simulations.

Figure 6:
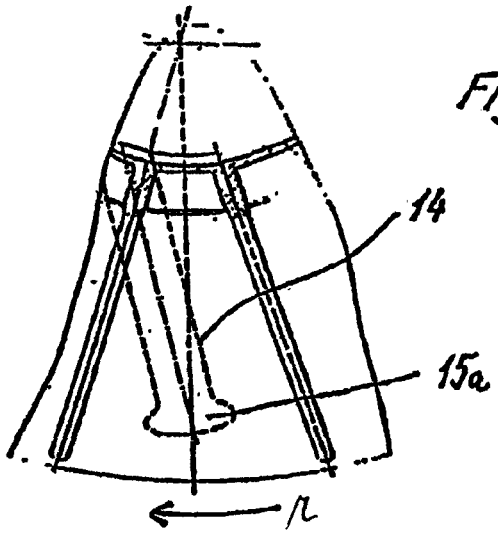
Figure 7:
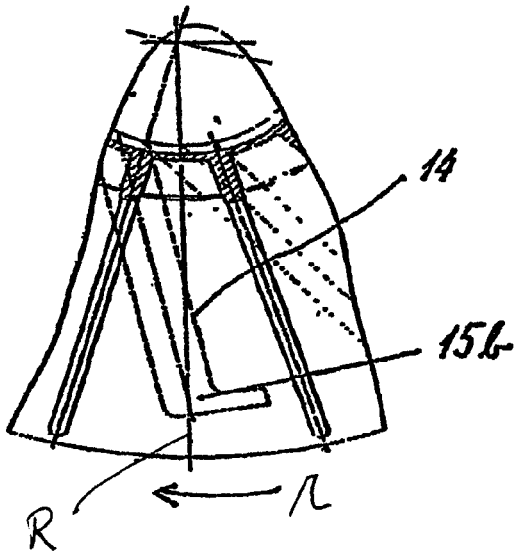
Figure 8:
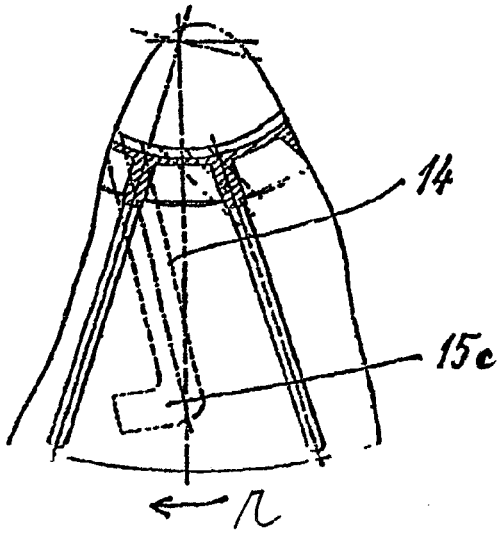

FIGS. 6 to 8 illustrate that, by an optimized development of the distributor, it becomes possible to further optimize the flow conditions in the drum 21 (see FIG. 9) as well as in the disc stack 26.

A one-piece distributor 22 (see FIG. 10) is provided with distributor channels 14 which are not radially oriented. The channels 14 are constructed as a bore (see FIG. 9) and, first extend in a first bore section in the drum 21 in a sloped manner from an inside to an outside in a downward direction and end in a bore section which is constructed as an expanding or geometrically changing distributor outlet 15*a*. This distributor outlet 15*a* is directed upward in the drum 21 and leads directly below one of the rising channels 3. Its outlet area may have a circular or, for example, slot-type shape. Slot-type distributor outlets 15*b* (see FIG. 7) from the bores of the distributor channels 14 may then, in turn, extend relative to a remaining distributor channel tangentially to radial line R in the rotating direction r of drum 22 (FIG. 7) or against (FIG. 8) the rotating direction r of the drum 22, or may advance or lag.

It thus becomes possible to optimize the flowing of product into the drum 22 as well as into the disc stack 26 in a very targeted manner while a feeding bore cross-section is optimized. This is in order to achieve an improved separation of particles and, if required, improve a parallel connection of the discs 1.

Figure 9:
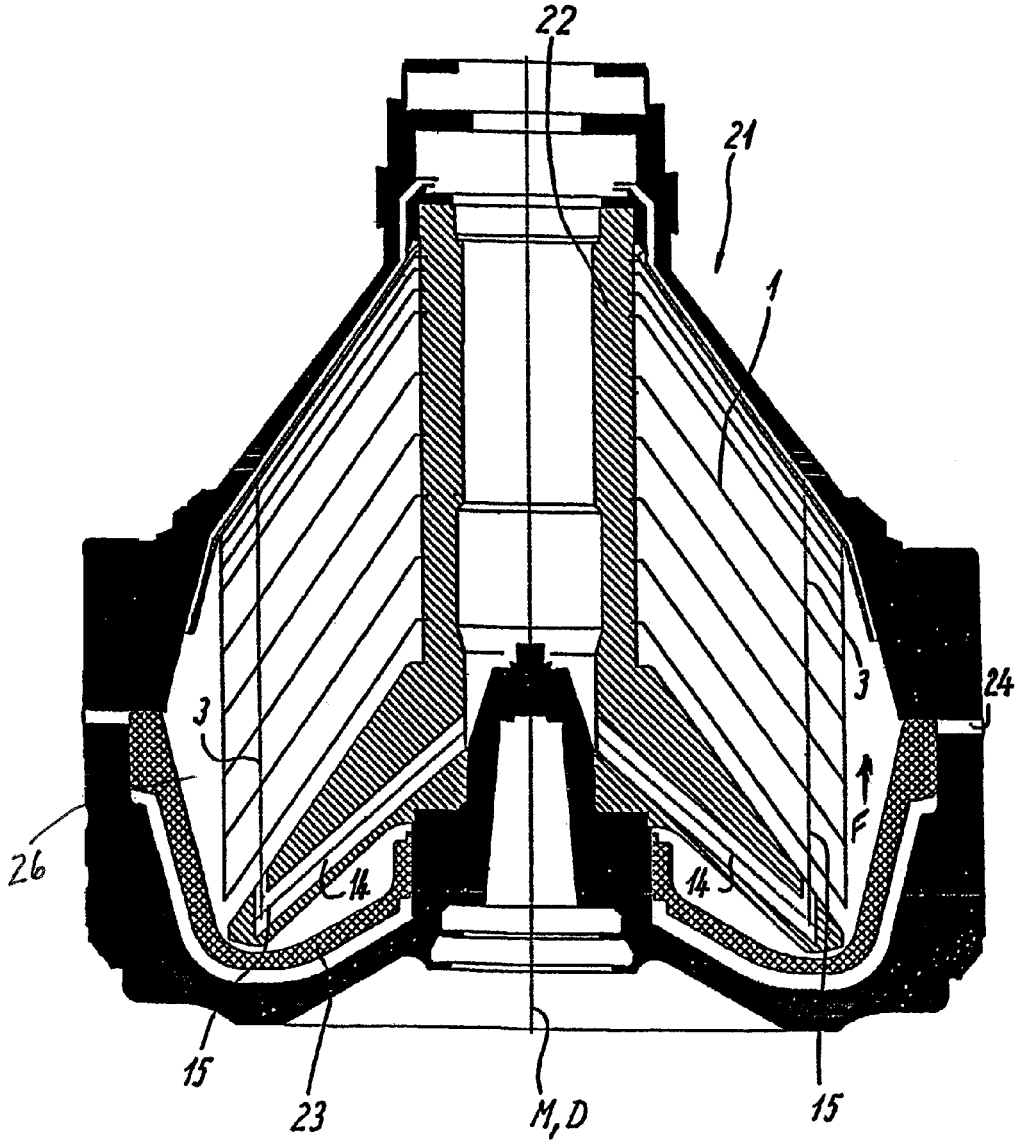
FIG. 9 is a sectional view of a separator having two distributor channels, according to the present disclosure.
Figure 10:
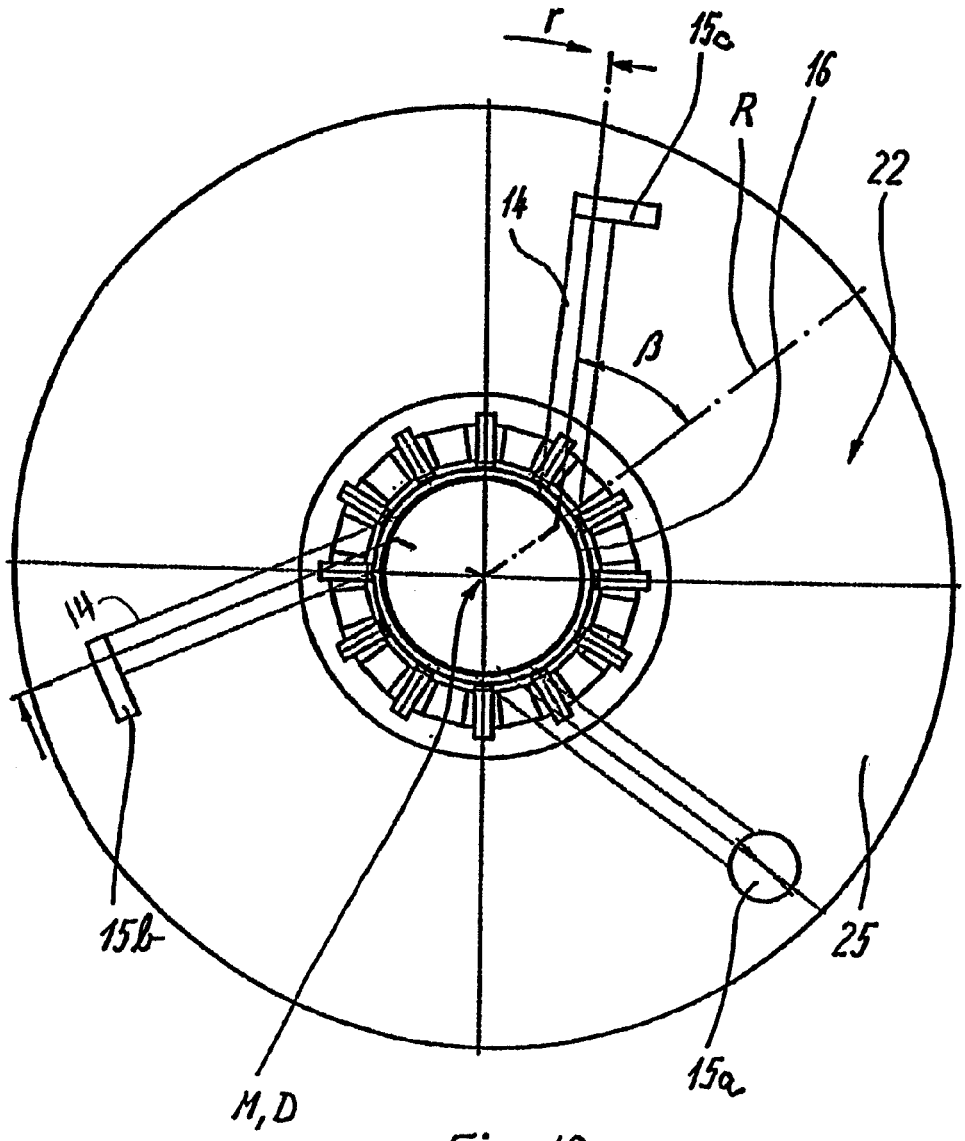
FIG. 10 is a top view of a distributor for the separator of FIG. 7.

FIG. 9 is a cross-sectional view of a schematically illustrated self-discharging separator having a drum 21 with a vertical axis of rotation D, which has a distributor 22. A feeding pipe, which is not shown, leads from above into the distributor 22. The distributor 22 has the upper distributor shaft 16, which is oriented concentrically with respect to the axis of rotation D. The distributor 22 includes distributor channels 14 which are constructed as bores and each lead into one of the distributor outlets 15 (as shown in FIG. 9) or 15*a,b,c* (as shown in FIG. 10). A piston valve 23 is used for the opening and closing of solids discharge openings 24. The liquid discharge from the drum 24 takes place by grippers or centripetal pumps (not shown).

FIG. 10 is a top view of the distributor 22 with the distributor shaft 16 and the lower, radially expanding, almost disc-type base section 25. Section 25 is penetrated by, for example, three distributor channels 14, shown here by broken lines, and leading into the distributor outlets 15*a,b,c*.

Straight bores, which form the distributor channels 14 in the one-piece distributor 22, are not arranged radially but relative to the radial line R through the drum axis M (congruent with the axis of rotation D) in a lagging manner with respect to the rotating direction r, which permits a careful inflow of the centrifugal material.

The holes of the rising channel 14 are designed not to be constant over the height of the disc stack 26. The holes are designed in an optimized manner with respect to the flow conditions to not be constant, that is, to be variable. An angle β between the distributor channels 14 and the radial line R, which extends through a starting area of the distributor channel 14 at an inner circumference of the distributor 22, amounts to between 15 and 85°, particularly between 25° and 65°, in order to achieve a careful inflow of the centrifugal material into the drum 21.

The distributor outlets 15*a,b,c* may have various geometries which are also adapted to the rising channels 3 and which may be oriented to be lagging 15*b*, advancing 15*c* or "neutral" 15*a* relative to a lagging distributor arm (see also FIG. 10).

Although the present disclosure has been described and illustrated in detail, it is to be clearly understood that this is done by way of illustration and example only and is not to be taken by way of limitation. The scope of the present disclosure is to be limited only by the terms of the appended claims.

I claim:

1. A separator, comprising:

a vertical axis of rotation;

a drum having solids discharge openings and a conical centrifugal space;

a disc stack located in the conical centrifugal space and including a plurality of conical discs super-imposed on one another, the conical discs having disc bores forming at least one rising channel in the disc stack;

a drum;

a distributor including a distributor shaft concentrically surrounding a drum axis of the drum, and further including a lower base section which expands radially, and on which lower base section are one or more distributor channels;

a diameter of the at least one rising channel inside the disc stack, located above the disc which is the lowest disc in a flow direction, is one or both of a) not constant and b) sloped with respect to the drum axis; and the one or more distributor channels are not radially oriented with respect to the drum axis.

2. The separator according to claim 1, wherein distributor bores forming the distributor channels are oriented relative to a radial line through the drum axis in a laggingly sloped manner in a radially interior bore section against a rotating direction of the drum.

3. The separator according to claim 1, wherein the one or more distributor channels is located in a bore section leading into the drum, which bore section is oriented upward in the drum and leads out directly below one of the at least one channels of the disc stack into the drum.

4. The separator according to claim 1, wherein an angle between the one or more distributor channels and a radial line starting at an inner circumference of the one or more distributor channels is between 15 and 85°.

5. The separator according to claim 1, wherein the one or more distributor channels includes an outlet which extends tangentially either in or against a rotating direction of the drum.

6. The separator according to claim 1, wherein a geometry of the disc bores of the at least one rising channel varies in the at least one rising channel such that, during an operation, gaps between the discs are uniformly charged with liquid over an entire height of the disc stack.

7. The separator according to claim 1, further including a piston valve for opening and closing the solids discharge openings.

8. The separator according to claim 1, wherein the diameter of the at least one rising channel changes in steps over a distance of several discs.

9. The separator according to claim 1, wherein the diameter of the at least one rising channel changes continuously from one disc to the next disc.

10. The separator according to claim 1, wherein the diameter of the at least one rising channel decreases in a flow direction.

11. The separator according to claim 1, wherein a geometry of the disc bores changes from one disc to the next disc.

12. The separator according to claim 1, wherein the discs bores have a polygonal shape.

13. The separator according to claim 1, wherein the disc bores have a round shape.

14. The separator according to claim 1, wherein the disc bores have a curved shape.

15. The separator according to claim 1, wherein each of the at least one rising channel includes several disc bores.

16. The separator according to claim 1, wherein the disc bores of each of the at least one rising channel form a perforated pattern in the discs.

17. The separator according to claim 1, wherein the at least one rising channel is oriented to be sloped with respect to the drum axis.

18. The separator according to claim 1, wherein the at least one rising channel extends in a curved manner in the disc stack.

19. The separator according to claim 1, wherein the at least one rising channel includes a groove that is oriented asymmetrically with respect to a bisecting line of a disc segment to which the groove is assigned.

20. The separator according to claim 1, wherein the at least one rising channel includes a groove that is oriented to be laterally offset with respect to a bisecting line of a disc segment to which the groove is assigned and which is bounded by one or more of webs and lugs.

21. The separator according to claim 1, wherein the discs are placed on radial webs of the distributor shaft, and a discharge channel in the disc stack or a groove in the distributor shaft for the discharge is oriented asymmetrically with respect to a bisecting line of a disc segment.

22. The separator according to claim 1, wherein the at least one rising channel is for feeding product into the disc stack.

23. The separator according to claim 1, wherein the at least one rising channel is a discharge channel for discharging a liquid phase from the disc stack.

24. The separator according to claim 23, wherein the at least one discharge channel is constructed close to an inner circumference or close to an outer circumference of the disc stack inside the disc stack.

25. The separator of claim 1, wherein an angle between the one or more distributor channels and a radial line starting at an inner circumference of the at least one distributor channel is between 25° and 65°.

26. The separator of claim 1, wherein the one or more distributor channels includes an outlet which extends tangentially in an upward direction in the drum.

* * * * *